US007931490B2

(12) United States Patent
Pellen

(10) Patent No.: US 7,931,490 B2
(45) Date of Patent: Apr. 26, 2011

(54) INDICATING THE INTEGRITY OF A CONNECTOR SEAL

(75) Inventor: Alain T. Pellen, Boca Raton, FL (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 12/244,704

(22) Filed: Oct. 2, 2008

(65) Prior Publication Data

US 2009/0104806 A1 Apr. 23, 2009

Related U.S. Application Data

(60) Provisional application No. 60/999,651, filed on Oct. 19, 2007.

(51) Int. Cl.
*H01R 4/50* (2006.01)

(52) U.S. Cl. ..... 439/489; 439/277

(58) Field of Classification Search ..... 439/489, 439/277, 271

See application file for complete search history.

(56) References Cited

U.S. PATENT DOCUMENTS

| | | | | |
|---|---|---|---|---|
| 5,641,306 | A * | 6/1997 | Stepniak | 439/491 |
| 5,670,884 | A * | 9/1997 | Kodama | 324/538 |
| 6,921,283 | B2 * | 7/2005 | Zahlit et al. | 439/489 |
| 7,044,769 | B2 * | 5/2006 | Zhao et al. | 439/489 |
| 7,497,723 | B2 * | 3/2009 | Brassell et al. | 439/489 |
| 2002/0022397 | A1 * | 2/2002 | Hillman et al. | 439/489 |
| 2003/0100213 | A1 * | 5/2003 | Yoshigi et al. | 439/372 |
| 2006/0116022 | A1 * | 6/2006 | Norwood et al. | 439/489 |
| 2008/0166913 | A1 * | 7/2008 | Siebens et al. | 439/489 |
| 2008/0311779 | A1 * | 12/2008 | Brassell et al. | 439/345 |

* cited by examiner

*Primary Examiner* — Gary F. Paumen

(74) *Attorney, Agent, or Firm* — Mark Wurm; Dylan O. Adams; Graybeal Jackson LLP

(57) ABSTRACT

An embodiment of a device for indicating the integrity of a seal between engaged connectors of a connection assembly. According to an embodiment, a connection assembly includes a first connector having at least one indicator receptacle. The indicator receptacle may receive a removable indicator capable of determining the integrity of a liquid-tight seal within the first connector. Typically, the assembly also includes a second connector operable to interface with the first connector. Further, the indicator includes a cam assembly operable to engage the first connector such that the cam assembly physically indicates when sealing surfaces within the connectors are properly seated with one another.

20 Claims, 2 Drawing Sheets

INDICATING THE INTEGRITY OF A CONNECTOR SEAL

PRIORITY CLAIM

This patent application claims priority from a related U.S. Provisional Patent Application No. 60/999,651 entitled 'INDICATING THE INTEGRITY OF A CONNECTOR SEAL' filed on Oct. 19, 2007 which is incorporated herein in its entirety.

BACKGROUND

Electrical devices and components may rely upon electrical and communication couplings between various power sources, communication ports, and signal path connections. It is common for any of these needed connections to have couplings that may be connected and disconnected as needed so as facilitate moving, replacing, and maintaining such electrical devices and components. In its simplest form, such an electrical connection may be a common wall outlet and a common power cord for a toaster that plugs into the wall outlet. Of course, as electrical devices and components become more complex, electrical connections and connectors may also be more complex, often having 20 or more distinct signal connections within a single connection point.

Often, such electrical connections require a more secure connection than what is typically provided with a common wall outlet and the like. For example, an electrical connection deployed in an outdoor environment may require some kind of water-tight or protected connectivity. Further, for an electrical connection that is submerged in water (or any liquid) as may be present on a submergible water craft and the like, may require a liquid-tight connection. Such liquid-tight connectors have been in conventional use for some time as are generally described with respect to FIG. 1.

Referring to FIG. 1, a conventional liquid tight connection includes a male end 12 and a female end 14. As shown in FIG. 1, these two ends are engaged with each other, i.e., coupled. The female end 14 includes a locking ring (sometimes called a coupler) 16 having a multi-grooved exterior for easy gripping when rotating and handling. Additional detail underneath the locking ring 16 is shown in an exploded view within FIG. 1. Within this view, one can see threaded portions 18*a* and 18*b* that are formed in both the male 12 and female 14 ends interfacing with each other. Threaded portion 18*a* corresponds to the exterior of the insertable end of the male end 12. Likewise, threaded portion 18*b* corresponds to the interior side of the locking ring 16 of the female end 14. Within the female end 14 is a quasi-malleable, e.g., rubber, seal structure 20 which is used to form a seal when properly connected to the male end 12. This seal structure 20 typically features a seal protrusion 22 having a female end sealing surface 23 that is designed to engage the male end 12 and form a liquid-tight seal when properly seated with a male end sealing surface 43. Also within the female end 14 is a non-malleable, e.g., steel, pressing structure 24 having a pressing surface 25.

When engaging the two ends 12 and 14 of the coupling, one typically inserts the male end 12 into the female end 14 and then rotates the locking ring 16 such that the threaded sections 18*a* and 18*b* engage each other. As the locking ring 16 rotates, it forces the female end sealing surface 23 and the male end sealing surface 43 toward each other. As rotation of the locking ring 16 is continued, the threaded portions 18*a* and 18*b* draw the ends 12 and 14 together until the sealing surfaces 23 and 43 come into contact with each other. At this point, one may apply additional rotational force at the locking ring 16 to more securely engage the sealing surfaces 23 and 43 with a force sufficient to form a liquid-tight seal between the sealing surfaces such that liquid cannot enter an inner chamber 28 of the assembled connector.

However, such a conventional connection as shown in FIG. 1 has drawbacks as it may fail without such a failure being detectable. One particular problem is that the connection may appear to be sufficiently connected such that the sealing surfaces 23 and 43 are fully engaged, but in reality something is preventing the locking ring 16 from fully rotating to a liquid-tight sealed position. For example, rust or other debris on the threaded portions 18*a* or 18*b* may hinder the rotation of the locking ring 16 and cause it to feel "tight" even when the sealing surfaces 23 and 43 are not sufficiently seated against each other to form a proper liquid-tight seal. A similar problem may be caused when the threaded portions 18*a* of the locking ring 16 and the corresponding threaded portion 18*b* of the male end 12 are cross threaded such that, again, the sealing surfaces 23 and 43 are not sufficiently seated against each other to form a proper liquid-tight seal.

Therefore, what is needed is a more discernable indication that the male end 12 and the female end 14 of connection is seated properly such that the connection is, in fact, liquid-tight and properly sealed.

BRIEF DESCRIPTION OF THE DRAWINGS

Aspects and many of the attendant advantages of the subject matter disclosed herein will become more readily appreciated as the same become better understood by reference to the following detailed description, when taken in conjunction with the accompanying drawings, wherein.

DETAILED DESCRIPTION

Figure 1:
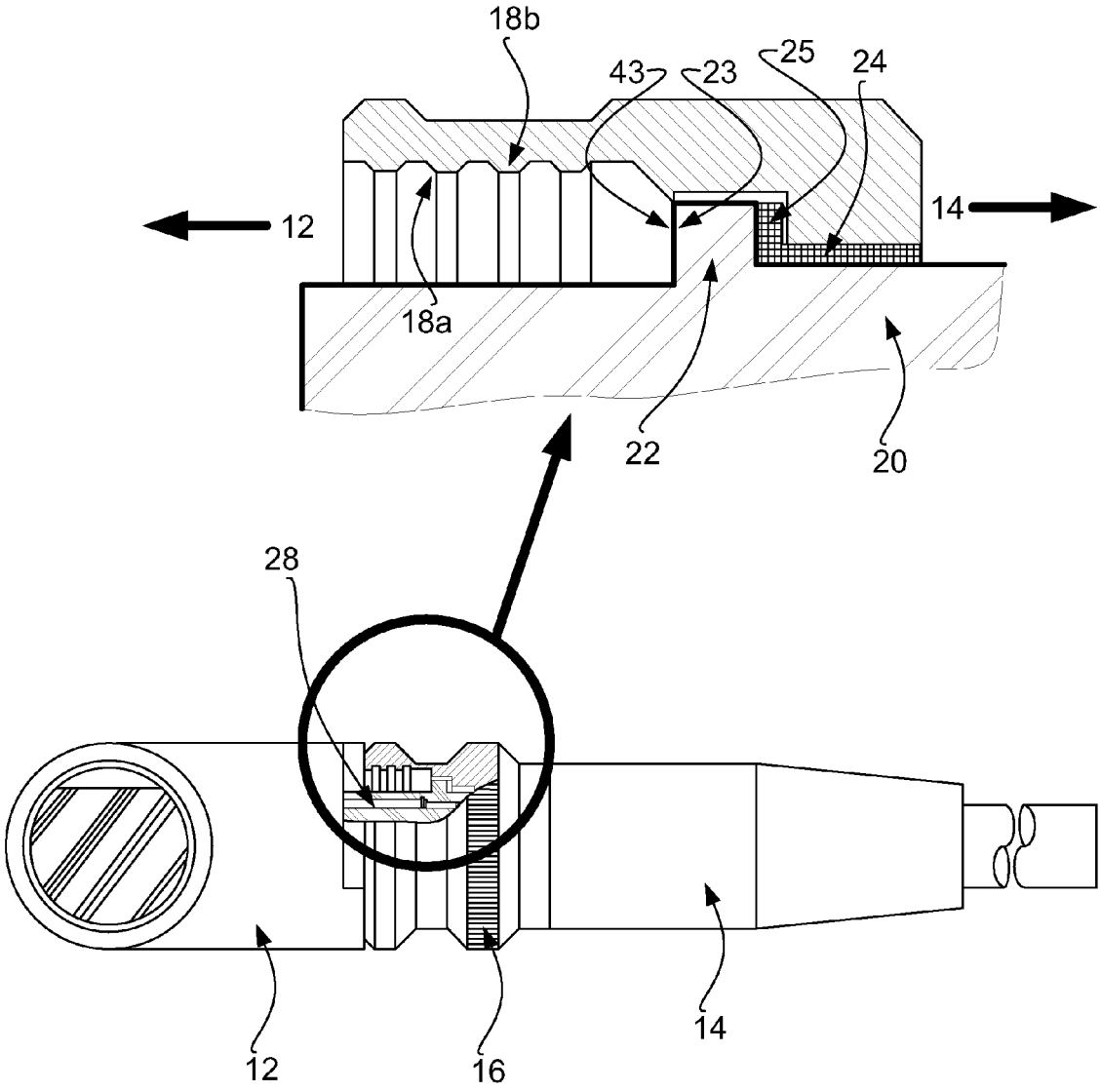
FIG. 1 (PRIOR ART)
FIG. 1 shows a diagram of a conventional electrical connection having a conventional liquid-tight sealing mechanism.

The following discussion is presented to enable a person skilled in the art to make and use the subject matter disclosed herein. The general principles described may be applied to embodiments and applications other than those detailed above without departing from the spirit and scope of the subject matter disclosed herein. This disclosure is not intended to be limited to the embodiments shown, but is to be accorded the widest scope consistent with the principles and features disclosed or suggested.

Furthermore, aspects of the subject matter detailed below resemble certain aspects of the prior art described above. As such, some reference numerals for similar portions of the disclosed subject matter retain the reference numerals as used in the description of the background. However, these similarities are illustrative purposes only and are merely intended to provide a better understanding of the inventive subject matter and do not constitute any characterization of the described embodiments of the inventive subject matter.

Figure 2:
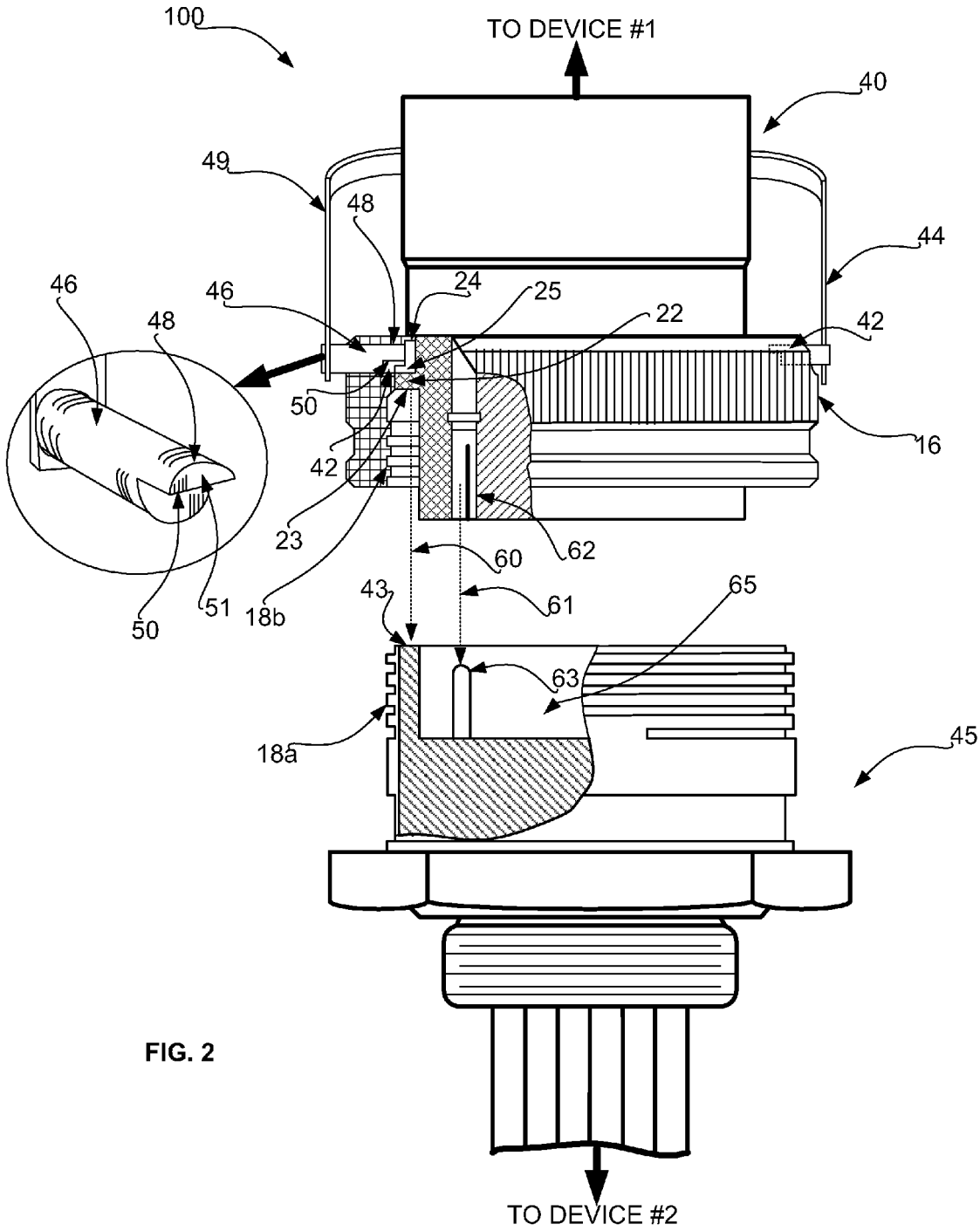
FIG. 2 shows a side view with portions broken away of an electrical connection having an improved liquid-tight electrical connection capable of indicating the integrity of the liquid-tight connection according to an embodiment of the subject matter disclosed herein.

FIG. 2 is a side view with portions broken away of an electrical connection assembly 100 having an improved liquid-tight electrical connection capable of indicating the integrity of the liquid-tight connection according to an embodiment of the subject matter disclosed herein. The connection assembly 100 includes a connector 40 that is similar to the female end 14 of FIG. 1, and a plug 45 that is similar to the male end 12 of FIG. 1. Sometimes, each end is simply referred to as a connector, i.e., a first connector 40 and second connector 45. Again, there are cutaway views of the interiors of the connector 40 and plug 45 to better illustrate the nature of the subject matter disclosed herein.

The connector 40 includes a locking ring 16 having interior threaded portion 18*b* that is designed to engage an exterior threaded portion 18*a* of the plug 45. When engaging the connector 40 to the plug 45, one typically inserts the plug 45 into the connector 40 and then rotates the locking ring 16 such that the threaded sections 18*a* and 18*b* engage each other. As rotation of the locking ring 16 continues, the threaded portions 18*a* and 18*b* draw the connector 40 and the plug 45 together until a connector sealing surface 23 comes into contact with a plug sealing surface 43. This is denoted in FIG. 2 by the arrow 60. At this point, one may apply additional rotational force to the locking ring 16 to more securely engage the connector sealing surface 23 with the plug sealing surface 43 with a force sufficient to form a liquid-tight seal such that liquid cannot enter an inner chamber 65 of the assembled connection when electrical connections are made; e.g., male terminal 63 engaged with female receptacle 62 as denoted by arrow 61.

The connector 40 is capable of interfacing with an indicator 44 for positively indicating that the seal between the connector sealing surface 23 and the plug sealing surface 43 is properly seated and liquid-tight. As such, the connector 40 further includes one or more holes 42 (sometimes referred to as indicator receptacles) that are formed through an exterior side of the locking ring 16. The holes 42 are defined by the top of the interior of the locking ring 16 and a steel (or other non-malleable substance) pressing member 24 that presses against a seal protrusion 22. These holes 42 may receive a mechanical indicator 44, hereinafter referred to as a cam assembly 44. In FIG. 2, there are two holes 42 on opposite sides (e.g., 180 degrees apart) of the locking ring 16 and a cam assembly 44 is shown with two cams 46 inserted into the holes 42.

In FIG. 2, the cam assembly 44 includes two cams portions 46, each of which are attached to a lever 49. The lever 49 is typically made of a quasi-flexible material such that each cam portion 46 may be maneuvered into each hole 42 on either side of the locking ring 16. Thus, one may insert the cams portions 46 into the hole(s) 42 such that the cam assembly 44 provides a physical indication as to whether the sealing surfaces 23 and 43 are properly seated relative to one another. This indication is a function of the physical interface of the cam portions 46 and the holes 42 as described further below.

The cam assembly 44 includes at least one cam portion 46 that includes a semi-circular protrusion 51 that may be inserted into the hole 42 and into a space formed between the top side of the steel pressing structure 24 and the top side of the interior of the locking ring 16. The protrusion 51 includes a rounded surface 48 and a flat surface 50 that form a half cylinder characterized by a width that is equal to the diameter of the semi-circle formed and a height that is equal to the radius of the semi-circle formed. The rounded surface 48 may have the same or a slightly smaller curvature, i.e., radius, as the hole 42. Of course, the width (diameter) is approximately twice the distance of the height (radius) of the protrusion 51.

When the connector 40 is not engaged with any plug 45, the space in the hole 42 between the top side of the locking ring 16 and the steel pressing structure 24 is typically greater than or equal to the width (i.e., diameter) of the protrusion. As such, when a cam portion 46 (in specific, the protrusion 51) is inserted into the hole 42, the entire cam assembly 44 is loose fitting and rotatable. That is, the lever 49 may be freely rotated away from the connector 40 causing the protrusion 51 to rotate a full 90 degrees or more. A rotation of 90 degrees causes the width dimension of the protrusion 51 to be vertical between the top side of the locking ring 16 and the steel pressing structure 24.

As the locking ring 16 rotates to a point where the protrusion 51 begins to contact the steel pressing structure 24, the rotation of the locking ring 16 (which draws the sealing surfaces 23 and 43 closer together) urges the cam portion 46 to rotate into a position where the flat surface 50 is facing toward the top surface of the pressing structure 24. That is, the space between the top side of the locking ring 16 and the steel pressing structure 24 becomes smaller than the width of the protrusion 51 and approaches a distance that is closer to the height (i.e., radius) of the protrusion 51. As the cam portion 46 rotates (clockwise in this embodiment), the lever 49 of the cam assembly 44 also rotates (also clockwise in this embodiment) back toward the connector 40.

The hole 42 and cam portion 46 are sized such that when the sealing surfaces 23 and 43 are properly seated, the flat surface 50 of the protrusion 51 faces toward and is urged against the top of the pressing structure 24 such that the cam portion 46 can no longer rotate within the hole 42. Therefore, one knows that the sealing surfaces 23 and 43 are properly seated when the lever 49 is pointing in a predetermined direction (e.g., relatively parallel with respect to the connection direction), and it can no longer be rotated. If one can rotate the lever 49, then this indicates that the sealing surfaces 23 and 43 may be improperly seated even if the locking ring 16 feels tight.

The cam assembly 44 may be made out of any suitable material, such as plastic or metal. Furthermore, the cam assembly 44 may have two cam portions 46, and the locking ring 16 may have two holes 42 that are spaced 180 degrees apart. Alternately, the cam assembly 44 may have just one or more than two cam portions 46, and/or the locking ring 16 may have just one or more than two holes 42. Furthermore, the cam assembly 44 may stay inserted in the hole(s) 42 for an indefinite period after the sealing surfaces 23 and 43 are properly seated, or one may remove the cam assembly 44 after confirming that the sealing surfaces 23 and 43 are properly seated.

Other embodiments of the connector 40 and cam assembly 44 are also contemplated. For example, where the cam assembly 44 is made from a rigid material, one may use the lever 49 of the cam assembly to assist in properly seating the sealing surfaces 23 and 43. For example, after the lever 49 is forced into the relatively parallel position, one may push on the lever 49 to rotate the cam portion 46 such that the flat surface 50 rotates away from the top of the pressing structure 24. This causes the cam portion 46 to press against both the interior top side of locking ring 16 and the pressing structure 24. Because the position of the locking ring 16 is fixed relative to a threaded portion 18*a* of the plug 45, the cam portion 46 forces the connector sealing surface 23 even further toward the plug sealing surface 43. Depending on the position of the locking ring 16 (i.e., how much of the locking ring 16 is engaged with the threaded portion 18*a*), the cam portion 46 may also urge the connector sealing surface 23 against the plug sealing surface 43, thus seating these surfaces. Then, one may fully tighten the locking ring 16, which maintains the proper seating of the sealing surfaces 23 and 43, until the cam lever moves to a position (e.g., substantially parallel with the connection direction) that indicates that the sealing surfaces 23 and 43 are seated against one another to form a liquid-tight seal.

While the subject matter discussed herein is susceptible to various modifications and alternative constructions, certain illustrated embodiments thereof are shown in the drawings and have been described above in detail. For example, the indicator 44 may take a form other than the cam assembly shown. Furthermore, although described as being a liquid-tight seal, the surfaces 23 and 43 may form a fluid-tight seal. In addition, although the connector assembly 100 is shown as being a screw-type electrical connector, the indicator 44, suitably modified, may be used with any other type of mechanical connector. Moreover, those skilled in the art will understand that various aspects described in less than all of the embodiments may, nevertheless, be present in any embodiment. It should be understood, however, that there is no intention to limit the subject matter disclosed herein to the specific forms disclosed, but on the contrary, the intention is to cover all modifications, alternative constructions, and equivalents falling within the spirit and scope of the disclosed subject matter.

What is claimed is:

1. An electrical connector, comprising:
an indicator; and
at least one indicator receptacle for receiving the indicator therein that is operable to indicate by rotation of the indicator when a sealing surface within the electrical connector is properly seated with a sealing surface within an engaging electrical connector.

2. The electrical connector of claim 1, further comprising a locking ring operable to engage the engaging electrical connector.

3. The electrical connector of claim 2 wherein the locking ring is operable to be rotated such that the electrical connector and the engaging electrical connector are engaged and the sealing surface within the electrical connector is seated with the sealing surface within the engaging electrical connector as a result of the rotating.

4. The electrical connector of claim 1, wherein the sealing surface within the electrical connector seated with the sealing surface within the engaging electrical connector further comprises a liquid-tight seal.

5. The electrical connector of claim 1, further comprising at least two indicator receptacles disposed on the electrical connector at opposite sides of the electrical connector.

6. The electrical connector of claim 1 wherein the indicator receptacle is formed by a hole disposed between a pressing structure and a locking ring within the electrical connector.

7. The electrical connector of claim 1, further comprising at least one electrical terminal operable to be interfaced with a reciprocal electrical terminal disposed in the engaging electrical connector.

8. A connection indication mechanism, comprising:
an indicator operable to mechanically engage a connection assembly, the indicator further operable to mechanically indicate when sealing surfaces within the connection assembly are properly seated by rotating the indicator in an indicator receptacle, the indicator and indicator receptacle disposed on a single electrical connector.

9. The connection indication mechanism of claim 8, wherein properly seated further comprises a liquid-tight seal formed between sealing surfaces.

10. The connection indication mechanism of claim 8, further comprising a semi-flexible material operable to be maneuverable and removable from the connector.

11. A connection indication mechanism, comprising:
an indicator operable to mechanically engage a connection assembly, the indicator further operable to mechanically indicate when sealing surfaces within the connection assembly are properly seated; and
a cam assembly including:
at least one cam portion operable to be inserted into an indication receptacle disposed on the connector; and
a lever attached to the at least one cam portion.

12. A connection indication mechanism, comprising:
an indicator operable to engage a connection assembly, the indicator further operable to indicate when sealing surfaces within the connection assembly are properly seated;
a cam assembly including:
at least one cam portion operable to be inserted into an indication receptacle disposed on the connector;
a cylindrical portion; and
a semi-cylindrical protrusion having a rounded shape attached to the cylindrical portion; and
a lever attached to the at least one cam portion.

13. A connection assembly; comprising:
a first connector having a first sealing surface and operable to interface with a second connector; and
a second connector having:
at least one indicator receptacle,
a second sealing surface; and
an indicator residing within the indicator receptacle operable to engage and be coupled to the second connector, the indicator further operable to indicate when first sealing surface and the second sealing surface are properly seated by a portion of the second connector engaging the indicator.

14. The connection assembly of claim 13, further comprising one or more electrical connections suitable for submerged operation.

15. The connection assembly of claim 13, further comprising a first device electrically coupled to the first connector and a second device electrically coupled to the second device.

16. The connection assembly of claim 13 wherein a liquid-tight seal is formed between the properly seated sealing surfaces.

17. The connection assembly of claim 13 wherein the indicator is not operable to rotate when the sealing surfaces are properly seated.

18. A method for sealing an electrical connection, the method comprising:
engaging a threaded portion of a first connector with a threaded portion of a second connector, the first connector comprising:
an indicator for indicating that sealing surfaces are properly seated, and
an indicator receptacle for holding the indicator; and
maneuvering the first connector toward the second connector until the indicator having a cam portion and coupled to the first connector engages a portion of the second connector and indicates that a first connector sealing surface is properly seated with a second connector sealing surface.

19. The method of claim 18, further comprising rotating a locking ring disposed on the first connector to properly seat the first connector sealing surface with the second connector sealing surface.

20. A method for sealing an electrical connection, the method comprising:
engaging a threaded portion of a first connector with a threaded portion of a second connector;
rotating a locking ring disposed on the first connector to maneuver the first connector toward the second connector until an indicator coupled to the first connector indicates that a first connector sealing surface is properly seated with a second connector sealing surface;

applying leverage to the indicator to more fully seat the first connector sealing surface with the second connector sealing surface; and rotating the locking ring a second time after applying leverage.

* * * * *